US005187365A

United States Patent [19]

Kelley

[11] Patent Number: 5,187,365

[45] Date of Patent: Feb. 16, 1993

[54] MASS SPECTROMETRY METHOD USING TIME-VARYING FILTERED NOISE

[75] Inventor: Paul E. Kelley, San Jose, Calif.

[73] Assignee: Teledyne MEC, Mountain View, Calif.

[21] Appl. No.: 788,581

[22] Filed: Nov. 6, 1991

Related U.S. Application Data

[63] Continuation-in-part of Ser. No. 662,217, Feb. 28, 1991, Pat. No. 5,134,286.

[51] Int. Cl.[5] ..... H01J 49/42

[52] U.S. Cl. ..... 250/282; 250/290; 250/292

[58] Field of Search ..... 250/282, 281, 290, 291, 250/292, 293

[56] References Cited

U.S. PATENT DOCUMENTS

| | | | |
|---|---|---|---|
| 3,334,225 | 8/1967 | Langmuir | 250/292 |
| 4,736,101 | 4/1988 | Syka et al. | 250/292 |
| 4,761,545 | 8/1988 | Marshall et al. | 250/291 |
| 5,075,547 | 12/1991 | Johnson et al. | 250/292 |
| 5,134,286 | 7/1992 | Kelley | 250/282 |

FOREIGN PATENT DOCUMENTS 362432 10/1986 European Pat. Off. .

OTHER PUBLICATIONS

Extension of Dynamic Range in Fourier Transform Ion Cyclotron Resonance Mass Spectrometry via Stored Waveform Inverse Fourier Transform Excitation, Tao-Chin Lin Wang, Tom L. Ricca & Alan Marshall, Anal. Chem., 1986 5B, 2935-2938.

*Primary Examiner*—Jack I. Berman
*Assistant Examiner*—James Beyer
*Attorney, Agent, or Firm*—Limbach & Limbach

[57] ABSTRACT

A method for performing mass analysis with dynamic mass resolution, in which a time-varying notch filtered broadband voltage signal (sometimes denoted as a time-varying "filtered noise" signal) is applied to a quadrupole mass filter. The time-varying filtered noise signal can consist of a rapid sequence of static (time-invariant) filtered noise signals, each defining a notch having a selected width and center location. The invention facilitates performance of mass analysis over a wide range of ion mass-to-charge ratios ("mass ranges") with adequate mass resolution. By appropriately choosing the width of each notch in the applied time-varying filtered noise, mass analysis can be performed with substantially constant mass separation over a wide mass range. In order to maintain substantially constant mass separation while analyzing a selected consecutive or non-consecutive sequence of ions (by passing such sequence of ions through the mass filter), the applied filtered noise should have narrower notches at times when ions with higher mass-to-charge ratio are to be selected, and wider notches at times when ions with lower mass-to-charge ratio are to be selected.

24 Claims, 1 Drawing Sheet

MASS SPECTROMETRY METHOD USING TIME-VARYING FILTERED NOISE

CROSS-REFERENCE TO RELATED APPLICATION

The present application is a continuation-in-part of pending U.S. patent application Ser. No. 07/662,217, filed Feb. 28, 1991, now U.S. Pat. No. 5,134,286.

FIELD OF THE INVENTION

The invention relates to mass spectrometry methods in which ions are selectively passed through a quadrupole mass filter. More particularly, the invention is a mass spectrometry method in which a time-varying, notched broadband voltage signal is applied to a quadrupole mass filter to selectively pass a (consecutive or nonconsecutive) mass sequence of ions through the mass filter, while rejecting other ions (radially) from the mass filter.

BACKGROUND OF THE INVENTION

In conventional mass spectrometry techniques, such as "MS/MS" and "CI" methods, ions having mass-to-charge ratio within a selected range are stored in a quadrupole ion trap. The stored ions are then allowed (or induced) to dissociate or react, and the resulting product ions are then ejected from the trap for detection.

For example, U.S. Pat. No. 4,736,101, issued Apr. 5, 1988, to Syka, et al., discloses an MS/MS method in which ions (having a mass-to-charge ratio within a predetermined range) are trapped within a threedimensional quadrupole trapping field. The trapping field is then scanned to eject unwanted trapped ions (ions other than parent ions having a desired mass-to-charge ratio) sequentially from the trap. The trapping field is then changed again to become capable of storing daughter ions of interest. The trapped parent ions are then induced to dissociate to produce daughter ions, and the daughter ions are ejected sequentially from the trap for detection.

In order to eject unwanted trapped ions from the trap prior to parent ion dissociation, U.S. Pat. No. 4,736,101 teaches that the trapping field should be scanned by sweeping the amplitude of the fundamental voltage which defines the trapping field.

U.S. Pat. No. 4,736,101 also teaches that a supplemental AC field can be applied to the trap during the period in which the parent ions undergo dissociation, in order to promote the dissociation process (see column 5, lines 43–62), or to eject a particular ion from the trap so that the ejected ion will not be detected during subsequent ejection and detection of sample ions (see column 4, line 60, through column 5, line 6).

U.S. Pat. No. 4,736,101 also suggests (at column 5, lines 7–12) that a supplemental AC field could be applied to the trap during an initial ionization period, to eject a particular ion (especially an ion that would otherwise be present in large quantities) that would otherwise interfere with the study of other (less common) ions of interest.

European Patent Application 362,432 (published Apr. 11, 1990) discloses (for example, at column 3, line 56 through column 4, line 3) that a broad frequency band signal ("broadband signal") can be applied to the end electrodes of a quadrupole ion trap to simultaneously resonate all unwanted ions out of the trap (through the end electrodes) during a sample ion storage step. EPA 362,432 teaches that the broadband signal can be applied to eliminate unwanted primary ions as a preliminary step to a chemical ionization operation, and that the amplitude of the broadband signal should be in the range from about 0.1 volts to 100 volts.

In another class of conventional mass spectrometry techniques (such as the technique described in U.S. Pat. No. 3,334,225, issued Aug. 1, 1967, to Langmuir), ions injected into a quadrupole mass filter translate (at least initially) along the filter's axis. The mass filter has elongated electrodes that are oriented parallel to the filter's axis, and a quadrupole electric field is established in the region between the electrodes by applying a voltage (having an RF component, and optionally also a DC component) across at least one pair of the electrodes. The electric field allows only selected ions (having mass-to-charge ratio within a selected range) to translate axially through the filter (to the filter's outlet end) and may reject undesired ions by ejecting them radially away from the filter axis. The selected ions can be detected by a detector positioned along the filter axis beyond the outlet end.

It is conventional to apply a notch filtered broadband voltage signal to the electrodes of a quadrupole mass filter for the purpose of eliminating a range of ions having mass-to-charge ratio outside a desired range (the range associated with the voltage signal's "notch"). Such a notch filtered broadband voltage signal will be denoted herein as a "filtered noise" signal.

However, filtered noise signals have not been applied to a quadrupole mass filter in a manner facilitating mass analysis (i.e., the selective transmission of a consecutive or non-consecutive mass sequence of ions through the filter). Thus, for example, U.S. Pat. No. 3,334,225 teaches application of a single, static filtered noise signal to a quadrupole mass filter, to pass ions having mass-to-charge ratio in a single range. Until the present invention, it was not known how to perform mass analysis with dynamic mass resolution (to maintain substantially constant mass separation over a wide mass range) by applying a time-varying filtered noise signal to a quadrupole mass filter.

Conventional apparatus (such as the circuitry described in U.S. Pat. No. 3,334,225) for applying filtered noise signals to quadrupole mass filters would be incapable of applying filtered noise signals in a rapid sequence (and thus incapable of applying, in effect, a notch having time-varying width and center), or incapable of applying such a filtered noise signal sequence in a manner providing sufficient mass resolution to facilitate mass analysis over typical mass ranges of interest. The latter problem occurs in operation of conventional quadrupole mass filters due to the inverse relation between ion mass, m, and the conventional quadrupole field stability parameter q:

$$q=2eV/[mr^2w^2],$$

where V is the amplitude of a sinusoidal RF voltage applied to the mass filter, "r" represents radial distance from the central longitudinal axis of the filter, "e" is the charge of an electron, and "w" is the angular frequency of the applied sinusoidal RF voltage. Because of the inverse relationship between mass and the parameter q, if one simply ramps the range of ion mass-to-charge ratios) using a conventional quadrupole mass filter, it is not possible to achieve substantially constant mass separation during the mass analysis operation.

SUMMARY OF THE INVENTION

The invention is a method for performing mass analysis with dynamic mass resolution, in which a time-varying notch filtered broadband voltage signal (sometimes denoted herein as a time-varying "filtered noise" signal) is applied to a quadrupole mass filter. The time-varying filtered noise signal can consist of a rapid sequence of static (timeinvariant) filtered noise signals, each defining a notch having a selected width and center location (or two or more such notches).

The invention facilitates performance of mass analysis over a wide range of ion mass-to-charge ratios ("mass ranges") with adequate mass resolution. By appropriately choosing the width of each notch in the applied time-varying filtered noise, mass analysis can be performed with substantially constant mass separation over a wide mass range. In order to maintain substantially constant mass separation while analyzing a selected consecutive or non-consecutive sequence of ions (by passing such sequence of ions through the mass filter), the applied filtered noise should have narrower notches at times when ions with higher mass-to-charge ratio are to be selected, and wider notches at times when ions with lower mass-to-charge ratio are to be selected.

In preferred embodiments of the inventive method, the mass filter is operated within an operating regime for which very wide mechanical tolerances are acceptable. In general, to select a sequence of ions having mass-to-charge ratios within a very wide range, the invention may employ a quadrupole mass filter having a long axial length.

DETAILED DESCRIPTION OF THE PREFERRED EMBODIMENTS

Figure 1:
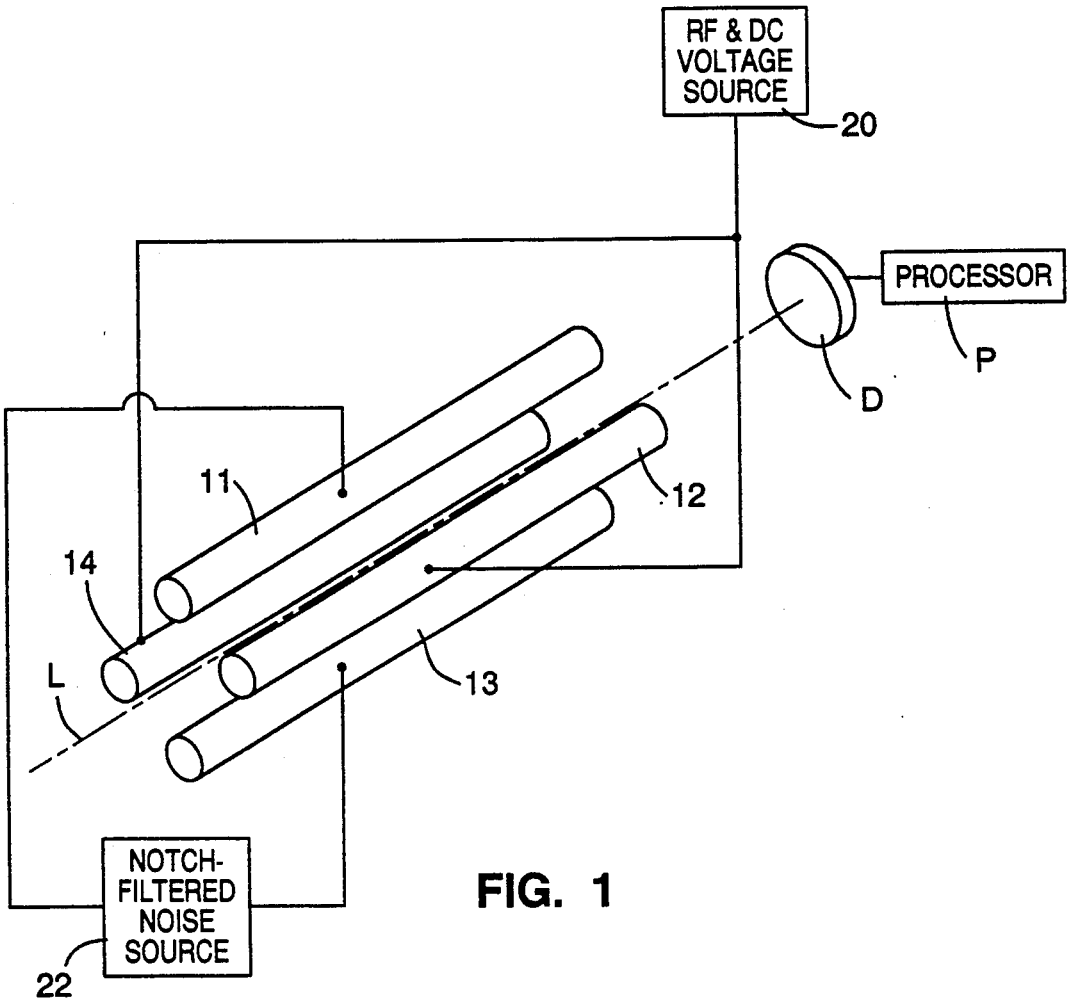
FIG. 1 is a simplified schematic diagram of an apparatus useful for implementing a class of preferred embodiments of the invention.

The quadrupole mass filter apparatus shown in FIG. 1 is useful for implementing a class of preferred embodiments of the invention. The FIG. 1 apparatus includes four elongated electrodes 11, 12, 13, and 14, each substantially parallel to the mass filter's central longitudinal axis L. A housing (not shown) will typically surround electrodes 11–14, so that the volume within the housing can be maintained at low pressure. A three-dimensional quadrupole field is produced in the region enclosed by electrodes 11 through 14 when fundamental voltage generator 20 is switched on to apply a fundamental voltage, having a radio frequency (RF) component and optionally also a DC component, across electrodes 12 and 14.

Preferably, the fundamental voltage signal has a DC component whose amplitude (U) is chosen to cause the quadrupole field between electrodes 11–14 to have both a high frequency cutoff and a low frequency cutoff for the ions it passes to detector D. Such low frequency cutoff and high frequency cutoff correspond, respectively (and in a well-known manner), to a particular maximum and minimum mass-to-charge ratio.

When a quadrupole field has been established in the region between electrodes 11–14, a stream of ions is introduced into this region from the end of the filter opposite detector D.

Filtered noise generator 22 is then switched on to apply a desired notch-filtered broadband AC voltage signal (e.g., a static filtered noise signal, or the inventive time-varying filtered noise signal) across electrodes 11 and 13. The characteristics of generator 22's output signal are selected (in a manner to be explained below) to reject all but selected ones of the ions from the filter in radial directions (away from axis L), as the ions propagate generally axially through the filter. The filtered noise signal asserted by generator 22 accomplishes this rejection operation by resonating the undesired ions radially at their radial resonance frequencies.

Ions which are not rejected from the filter will reach detector D positioned along axis L. The output of detector D can be supplied (optionally through appropriate detector electronics, not shown) to processor P.

Figure 2:
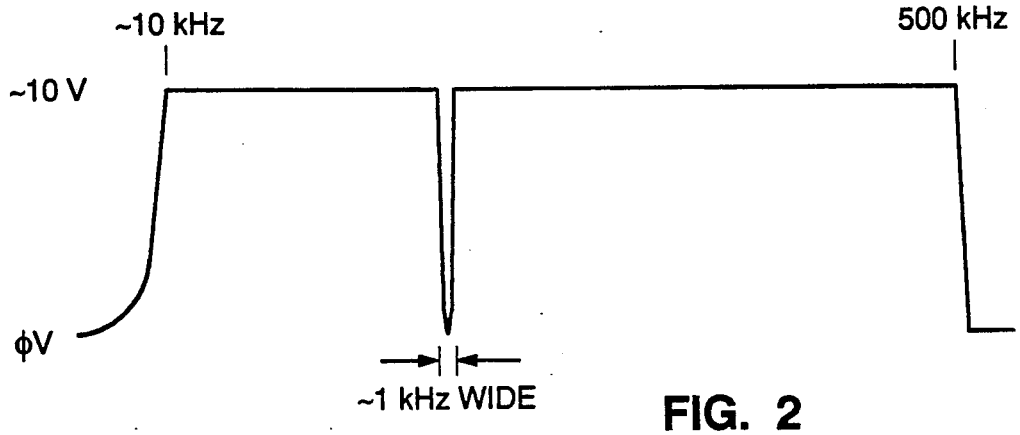
FIG. 2 is a graph representing the instantaneous frequency-amplitude spectrum of a time-varying filtered noise signal of the type applied during a preferred embodiment of the invention.

In accordance with the invention, generator 22 asserts a time-varying notch filtered broadband noise signal ("filtered noise" signal). FIG. 2 represents the instantaneous frequency-amplitude spectrum of such a time-varying filtered noise signal, in an embodiment of the invention in which the RF component of the fundamental voltage signal applied across electrodes 12 and 14 has a frequency of 1.0 MHz. As indicated in FIG. 2, the instantaneous bandwidth of the filtered noise signal extends from about 10 kHz to about 500 kHz (with components of increasing frequency corresponding to ions of decreasing mass-to-charge ratio). There is a notch (having width approximately equal to 1 kHz) in the filtered noise signal at a frequency (between 10 kHz and 500 kHz) corresponding to the radial resonance frequency of a particular ion to be passed through the filter.

Generator 22 preferably includes digital signal processing circuitry capable of asserting a time-varying filtered noise signal consisting of static filtered noise signals (such as that whose frequency-amplitude spectrum is shown in FIG. 2) asserted in a rapid sequence. In general, each such static signal will have a notch with a different width, centered at a different center location. Alternatively, the filtered noise signal is changed dynamically to scan and produce a mass spectrum.

In accordance with the invention, dynamic mass resolution is achieved by appropriately choosing the width of each notch in the time-varying filtered noise signal applied during a mass analysis operation. In this way, the invention enables mass analysis to be performed with substantially constant mass separation over a wide mass range of ions of interest. In order to maintain substantially constant mass separation while analyzing a selected consecutive or non-consecutive sequence of ions (by passing such ion sequence through electrodes 11–14), the applied filtered noise signal should have narrower notches at times when ions with higher mass-to-charge ratio are to be selected, and wider notches at times when ions with lower mass-to-charge ratio are to be selected.

In preferred embodiments of the inventive method, fundamental voltage asserted by source 20 is selected so that the mass filter operates within an operating regime for which very wide mechanical tolerances are acceptable (in the geometry of electrodes 11–14 and the surrounding housing). In general, to select a sequence of ions having mass-to-charge ratios within a very wide range, the invention must employ a quadrupole mass filter with electrodes 11–14 that have long axial length.

In alternative embodiments of the invention, mass analysis is implemented with a mass filter employing a multipole field of higher order than a quadrupole field (such as a hexapole, octapole, or other higher order multipole field). Such alternative embodiments are identical to the above-discussed embodiments using quadrupole mass filters, except that they apply a time-varying filtered noise signal to a multipole mass filter (rather than to a quadrupole mass filter). The expression "multipole field" is used in the claims to denote a field of higher order than a quadrupole field (such as a hexapole or octapole field), and the expression "multipole mass filter" is used in the claims to denote a mass filter which produces a such a multipole field.

In other embodiments of the invention, the field of a mass filter (which can be a quadrupole field or a higher order multipole field) is scanned while the time-varying filtered noise signal of the invention is applied to the mass filter.

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. A mass analysis method, including the steps of:

(a) establishing a quadrupole field in a region within a quadrupole mass filter, said quadrupole mass filter having electrodes oriented substantially parallel to a central axis, and said region having a first end and a second end separated from the first end along the central axis;

(b) after step (a), introducing ions into the region from said first end;

(c) while performing step (b), applying a timevarying filtered noise signal across a first subset of the electrodes to reject unwanted ones of the ions radially from the region, thereby allowing a selected sequence of the ions to propagate axially through the region to the second end of the region.

2. The method of claim 1, also including the step of detecting the selected sequence of the ions.

3. The method of claim 1, also including the step of:

(d) scanning the quadrupole field while performing step (c).

4. The method of claim 1, wherein the selected sequence of the ions is a consecutive mass order sequence of ions.

5. The method of claim 1, wherein the selected sequence of the ions is a nonconsecutive mass order sequence of ions.

6. The method of claim 1, wherein the time-varying filtered noise signal includes a sequence of static notched broadband AC voltage signals, wherein each of the static notched broadband AC voltage signals has a frequency-amplitude spectrum defining at least one notch with a width and center location.

7. The method of claim 6, wherein the width and center location of each said notch are selected to achieve a desired dynamic mass resolution.

8. The method of claim 6, wherein the width and 1, center location of each said notch are selected to achieve substantially constant mass separation over said selected sequence of the ions.

9. The method of claim 8, wherein the static notched broadband AC voltage signals applied to select ions with higher mass-to-charge ratios have notches with narrower widths, and the static notched broadband AC voltage signals applied to select ions with lower mass-to-charge ratios have notches with wider widths.

10. A method for performing mass analysis using a quadrupole mass filter, wherein the quadrupole mass filter has electrodes oriented substantially parallel to a central axis, wherein the electrodes define a region having a first end, and a second end separated from the first end along the central axis, said method including the steps of:

(a) applying a fundamental voltage signal having an RF component to a first subset of the electrodes, thereby establishing a quadrupole field in the region;

(b) introducing ions into the region from the end;

(c) while performing step (b), applying a time-varying filtered noise signal across a second subset of the electrodes to resonate undesired ones of the ions from the region in directions perpendicular to the longitudinal axis, thereby allowing a selected sequence of the ions to propagate axially through the region to the second end.

11. The method of claim 10, wherein the fundamental voltage signal also has a DC component.

12. The method of claim 10, also including the step of detecting the selected sequence of the ions.

13. The method of claim 10, also including the step of:

(d) scanning the quadrupole field while performing step (c).

14. The method of claim 10, wherein the selected sequence of the ions is a consecutive mass order sequence of ions.

15. The method of claim 10, wherein the selected sequence of the ions is a nonconsecutive mass order sequence of ions.

16. The method of claim 10, wherein the time-varying filtered noise signal includes a sequence of static notched broadband AC voltage signals, wherein each of the static notched broadband AC voltage signals has a frequency-amplitude spectrum defining at least one notch with a width and center location.

17. The method of claim 16, wherein the width and center location of each said notch are selected to achieve a desired dynamic mass resolution.

18. The method of claim 16, wherein the width and center location of each said notch are selected to achieve substantially constant mass separation over said selected sequence of the ions.

19. The method of claim 16, wherein the static notched broadband AC voltage signals applied to select ions with higher mass-to-charge ratios have notches with narrower widths, and the static notched broadband AC voltage signals applied to select ions with lower mass-to-charge ratios have notches with wider widths.

20. A mass analysis method, including the steps of:

(a) establishing a multipole field in a region within a multipole mass filter, said multipole mass filter having electrodes oriented substantially parallel to a central axis, and said region having a first end and a second end separated from the first end along the central axis;

(b) after step (a), introducing ions into the region from said first end;

(c) while performing step (b), applying a time-varying filtered noise signal across a first subset of the electrodes to reject unwanted ones of the ions radially from the region, thereby allowing a selected sequence of the ions to propagate axially through the region to the second end of the region.

21. The method of claim 20, also including the step of detecting the selected sequence of the ions.

22. The method of claim 20, also including the step of:

(d) scanning the multipole field while performing step (c).

23. The method of claim 20, wherein the selected sequence of the ions is a consecutive mass order sequence of ions.

24. The method of claim 20, wherein the selected sequence of the ions is a nonconsecutive mass order sequence of ions.

* * * * *